US005728967A

United States Patent [19]

Parkes

[11] Patent Number: 5,728,967

[45] Date of Patent: Mar. 17, 1998

[54] SUPPRESSING EXPLOSIONS AND INSTALLATION

[76] Inventor: John H. Parkes, Redhall Mill Cottage, Colinton Dell, Edinburgh, United Kingdom, EH14 1JF

[21] Appl. No.: 744,982

[22] Filed: Nov. 7, 1996

[30] Foreign Application Priority Data

Nov. 8, 1995 [GB] United Kingdom ..... 9522880

[51] Int. Cl.[6] ..... F42D 5/00

[52] U.S. Cl. ..... 102/303; 588/203; 86/50

[58] Field of Search ..... 588/202, 203; 86/1.1, 50; 102/303

[56] References Cited

U.S. PATENT DOCUMENTS

| | | | |
|---|---|---|---|
| 2,699,117 | 1/1955 | La Prairie . | |
| 3,106,159 | 10/1963 | Abramson . | |
| 3,806,025 | 4/1974 | Marshall . | |
| 4,543,872 | 10/1985 | Graham et al. . | |
| 4,589,341 | 5/1986 | Clark et al. | 102/303 |
| 4,630,540 | 12/1986 | Trocino | 102/307 |
| 4,836,079 | 6/1989 | Barrett | 86/50 |
| 5,140,891 | 8/1992 | Husseiny et al. | 86/50 |
| 5,225,622 | 7/1993 | Gettle et al. | 86/50 |
| 5,386,779 | 2/1995 | Baker | 102/303 |
| 5,574,203 | 11/1996 | Noel et al. | 588/203 |

FOREIGN PATENT DOCUMENTS

| | | | |
|---|---|---|---|
| 0 276 918 | 8/1988 | European Pat. Off. . | |
| 1 516 640 | 7/1978 | United Kingdom | A62C 7/00 |

OTHER PUBLICATIONS

Database WPI, Week 7825, Derwent Publications Ltd., London, Great Britain; AN 78-E9703A & ZA, A, 7 650 622 (T. Wilson).

*Primary Examiner*—Ngoclan Mai

*Attorney, Agent, or Firm*—Calfee, Halter & Griswold LLP

[57] ABSTRACT

A method of limiting an environmental disturbance caused by exploding explosive material, comprising spraying liquid to generate a liquid dispersion about the explosive material to be exploded and detonating the explosive material so that it explodes in the dispersion. The invention also relates to an installation for limiting the environmental disturbance of an explosion.

17 Claims, 1 Drawing Sheet

SUPPRESSING EXPLOSIONS AND INSTALLATION

BACKGROUND OF THE INVENTION

This invention relates to a method and an installation for limiting the environmental disturbance of an explosion by generating an airborne liquid dispersion in the vicinity of the explosion. In particular the invention is intended to limit chemical pollution (caused by chemical products from the blast cloud created on detonation) and/or sound pollution on detonation.

In many countries military explosives in long term storage are no longer needed. It is expensive to guard them and to move them to the most remote disposal sites. Controlled burning may cause more pollution and can lead to inadvertent high-order explosions. Intentional explosion under controlled conditions is the best option. However the quantities of explosives to be disposed of are enormous and the civilian irritation threshold for a long series of repeated explosions at random times is very low.

WO-A-95/08749 describes methods of generating an airborne liquid dispersion by the disruption of liquid-filled bags of thin-walled plastics material.

It has also been proposed to limit the environmental disturbance of an explosion by generating an airborne liquid dispersion which at least partly surrounds a body of explosive material and detonating the explosive material into the dispersion. In these prior proposals, it has been suggested that large volumes of liquid could be pumped from a pond at the bottom of a cliff into a tank at the top of the cliff. The water in the tank can be released in a deluge to fall on top of a suspended charge which is detonated as the cloud of water droplets from the falling water fall surround the charge. Alternatively, it has been proposed to project water from "water mortars" so that clouds of water droplets are fired onto a charge as it is detonated.

SUMMARY OF THE INVENTION

The present invention relates to an alternative method of supplying finely divided and/or aerozolised water to a body of explosive material to limit the environmental disturbance on detonating the explosive material. In particular the invention is intended to limit chemical and/or sound pollution on detonation.

According to one aspect of the present invention a method of limiting the environmental disturbance of an explosion by generating a liquid dispersion which at least partly surrounds a body of explosive material and detonating the explosive material into the dispersion, is characterised in that the liquid dispersion is created by spraying the liquid, preferably water, towards the body of explosive materials from at least one spray nozzle.

The liquid dispersion is able to remove chemical (or radioactive) products from a blast cloud created on detonation. To assist in this chemical removal process, additives (such as neutralising agents to counteract poisonous chemicals, sterilising agents to counter biological materials and capture media for limiting the spread of radioactive materials) can be added to the liquid spray. The liquid spray also attenuates the sound created on detonation.

Preferably the body of explosive material is positioned in a demolition disposal pit (or other sunken area) and a plurality of spray nozzles, preferably in fixed positions, are arranged to direct water in a spray into the interior of the pit. Conveniently such a pit is reinforced, e.g. a concrete pit lined with heavy armour plate.

Baffle walls may be positioned around the body of explosive material for sound attenuation. The baffle walls are conveniently armoured and may also be positioned to protect the spray nozzles on detonation of the explosive material.

Suitably the water is supplied to the spray nozzles from a pressurised water supply system. Conveniently the water is filtered and cycled for re-use.

According to another aspect of the invention there is provided a system and an installation for limiting the environmental disturbance of an explosion.

BRIEF DESCRIPTION OF THE DRAWINGS

Embodiments of the invention will now be described, by way of example only, with particular reference to the accompanying drawings, in which.

DESCRIPTION OF THE PREFERRED EMBODIMENTS

Figure 1:
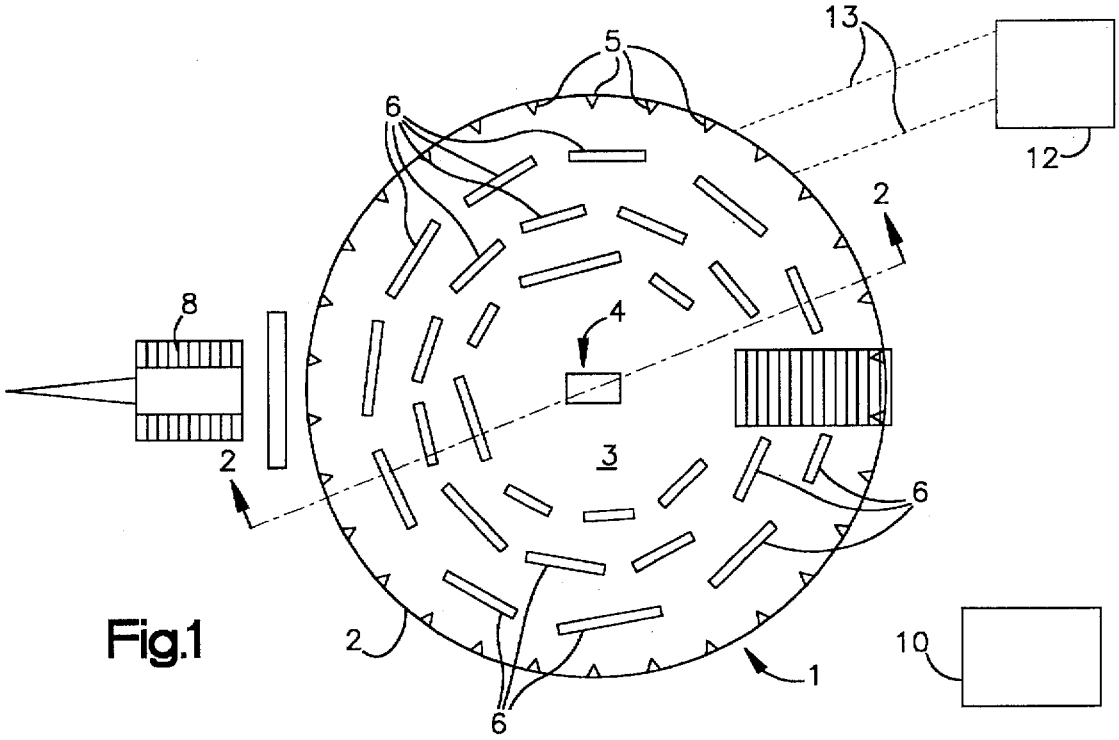
FIG. 1 is a schematic plan of an installation for limiting the environmental disturbance of an explosion.
Figure 2:
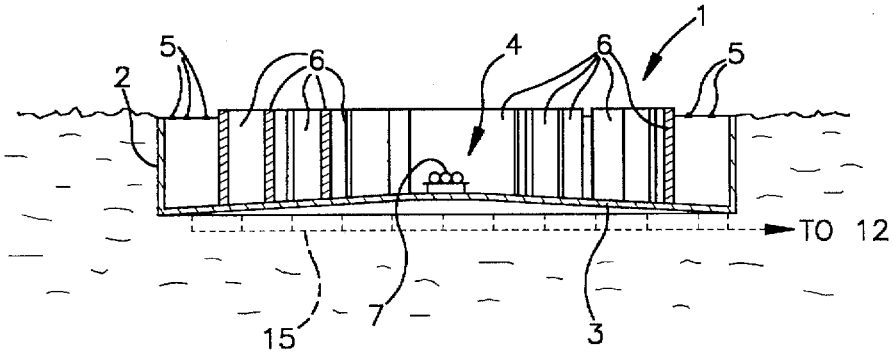
FIG. 2 is a schematic sectional view taken on the line II—II of FIG. 1.

FIGS. 1 and 2 show a reinforced sunken demolition disposal pit 1 about 30 m in diameter and having drainage channels 15. The pit is generally circular in shape and has a cylindrical side wall 2, typically at least 3 m high, and a floor or bottom wall 3 having a raised central munition disposal region 4. The pit is suitably made of reinforced material with its walls lined with heavy amour plating.

Atomising/spraying nozzles 5 are arranged in fixed positions in a ring around the top of the side wall 2. These nozzles 5 are supplied from a common high pressure feed station 12 via underground pipes 13 which form part of a water re-cycling and filtering system.

A plurality of armoured steel baffle plates 6 are positioned on the floor or bottom wall 3 around the munition disposal region 4.

In use, munitions 7 destined for disposal are placed in the pit 1 at the disposal region 4. The munitions 7 may, for example, be positioned in the pit 1 using a fixed or mobile crane 8, suitably having a magnet for facilitating lifting of scrap metal, positioned behind a shield wall 14. Alternatively, if an access ramp 9 or the like is provided, the munitions could be positioned using a rough terrain fork lift truck or the like. If provided, the ramp 9 is typically hydraulically operated and is folded away during the actual demolition phase.

The munitions are countercharged with donor charges and all personnel are made to retire to a purpose built safety bunker 10.

The spraying nozzles 5 are then activated and the entire pit area is blanketed with finely divided droplets and fully aerozolised water. When the operational area is satisfactorily blanketed with the requisite water mist, the munitions are detonated. This process can be repeated after safety procedures have been executed and the pit recharged with munitions.

To help reduce damage to the floor of the disposal pit 1, the munitions are conveniently stacked on bales of straw, bubble packs or some such similar material. The munitions—whether crated or banded on pallets—could also be raised or "stood off" from the ground using, for example, a light timber frame typically made from 50 mm×50 mm lengths of timber. By raising the explosives/munitions in this manner from the pit floor, damage to the floor is minimised. Alternatively, or in addition, the floor of the disposal pit could also be covered with several feet of sand. In use the sand would become saturated with water which would help prevent localised damage and attenuate sound.

Although the use of armour plated baffles is preferred, the sound attenuation of light charges and munitions can be achieved with the use of plywood or the like boards. The purpose of the baffles is primarily to reflect exploding material back into the water mist to reduce the level of sound. In addition, however, the baffles may be positioned to protect the nozzles 5.

The dimensions of the pit and the construction materials used will be dictated by the amount and specific types of munitions it is required to dispose of. Typically, however, a pit for a NEQ (net explosive content) of 50 kg would typically have a diameter of about 30 m and a side wall height of about 3 m. Obviously larger and more heavily constructed pits could be built which would be capable of withstanding and attenuating the effects of larger NEQs.

The liquid dispersion created by the spray nozzles is effective in removing chemical products from a blast cloud. By the addition of suitable additives to water as it is sprayed, the removal of chemical products can be enhanced.

The invention is not limited to the embodiments disclosed, but several variations or modifications thereof are feasible, including variations which have features equivalent to, but not necessarily literally within the meaning of, features in any of the appended claims.

I claim:

1. A method of limiting an environmental disturbance caused by exploding explosive material, comprising generating a liquid dispersion which at least partly surrounds a body of explosive material and detonating the explosive material so that it explodes in the dispersion, wherein the liquid dispersion is created by spraying liquid towards the body of explosive material from at least one spray nozzle.

2. A method according to claim 1, wherein said liquid comprises water.

3. A method according to claim 1, in which said liquid includes at least one additive for assisting removal of chemical products from a blast cloud created on detonation.

4. A method according to claim 3, in which said at least one additive is selected from neutralising agents to counteract poisonous chemicals, sterilising agents to counter biological materials and capture media for limiting the spread of radioactive materials.

5. A method according to claim 1, wherein said body of explosive material is positioned in a sunken area and a plurality of spray nozzles is arranged to direct water in a spray into the interior of the sunken area to create said liquid dispersion.

6. A method according to claim 5, in which said spray nozzles are in fixed positions.

7. A method according to claim 5, in which said sunken area comprises a demolition disposal pit which is reinforced.

8. A method according to claim 7, wherein said demolition disposal pit has concrete walls.

9. A method according to claim 1, wherein baffle walls are positioned around the body of explosive material for sound attenuation.

10. A method according to claim 9, wherein the baffle walls are armoured.

11. A method according to claim 9, in which the baffle walls are positioned to protect the spray nozzles on detonation of the explosive material.

12. A method according to claim 1, wherein said liquid supplied to the spray nozzles is supplied from a pressurised liquid supply system.

13. A method according to claim 12, wherein the liquid is filtered and cycled for re-use.

14. An installation for limiting the environmental disturbance of an explosion, comprising a demolition disposal pit having a central munition disposal region and a plurality of liquid spraying devices positioned around, and directed to spray liquid towards, said central munition disposal region for creating a liquid dispersion around said central munition disposal region into which a body of explosive material at said central munition disposal region can be detonated.

15. An installation according to claim 14, comprising baffle walls within said pit and positioned around the central munition disposal region.

16. An installation according to claim 15, wherein the baffle walls are positioned between the liquid spraying devices and the central munition disposal region.

17. An installation according to claim 15 or 16, in which said baffle walls are armoured.

* * * * *